United States Patent [19]

Tenold et al.

[11] 4,413,747

[45] Nov. 8, 1983

[54] FLOATING LID FOR A LIQUID STORAGE TANK

[75] Inventors: Tyrus N. Tenold; Michael D. Cossette; James P. Kuntz; Jack D. Gordon, all of Spokane, Wash.

[73] Assignee: Spokane Industries, Inc., Spokane, Wash.

[21] Appl. No.: 387,796

[22] Filed: Jun. 14, 1982

[51] Int. Cl.[3] ..... B65D 88/48; B65D 88/34

[52] U.S. Cl. ..... 220/225; 220/216; 220/227; 220/222

[58] Field of Search ..... 210/DIG. 9; 220/216–227, 93, 234, 232, 236, 238; 4/498–503

[56] References Cited

U.S. PATENT DOCUMENTS

| | | | |
|---|---|---|---|
| 986,297 | 3/1911 | Kinkade | 220/236 |
| 1,244,220 | 10/1917 | Lorcher | 220/220 X |
| 1,360,471 | 11/1920 | Taylor | 217/86 |
| 1,748,231 | 2/1930 | Kimbell | 220/227 X |
| 2,026,762 | 1/1936 | Verner | 220/222 |
| 2,096,358 | 10/1937 | Gautier | 220/93 |
| 2,172,457 | 9/1939 | Schwartz | 220/93 |
| 2,422,394 | 6/1947 | Carter, Jr. | 210/DIG. 9 |
| 2,806,625 | 9/1957 | Wiggins | 220/220 X |
| 2,838,199 | 6/1958 | Wiggins | 220/220 |

*Primary Examiner*—Allan N. Shoap
*Assistant Examiner*—Robert Petrik
*Attorney, Agent, or Firm*—Wells, St. John & Roberts

[57] ABSTRACT

A lid is described for floating on the surface of a liquid in a storage tank. The lid spans the tank interior and includes an inflatable peripheral seal arrangement selectively operable to seal the liquid within the tank upon inflation and, on deflation, will allow the lid to float freely on the surface of the liquid. The lid is formed of two plates spaced apart by a circumferential rim defining a flotation cavity. Buoyance of the lid is such that the inflatable seal is carried above the liquid surface. The bottom plate is arched toward the top plate of the lid by a tension member extending between the two. The tension member is hollow and open to the area below the lid. The pressure relief valve is mounted in the hollow passageway to selectively allow escape of pressurized gas from below the lid. The seal arrangement is made so that the liquid level always remains below the sealed area between the lid and tank walls.

2 Claims, 6 Drawing Figures

FLOATING LID FOR A LIQUID STORAGE TANK

FIELD OF THE INVENTION

The present invention relates to covering of liquid in a tank at the liquid surface to effectively seal the liquid from the atmosphere.

BACKGROUND OF THE INVENTION

There are many situations wherein it is desired to avoid exposure of a liquid to the atmosphere and also to maintain a minimal air or gas pocket between the liquid surface and the seal. This is particularly desirable in the wine making industry, for example, where the volume of liquid to be sealed varies as liquids are added or removed. An air space above the wine will cause an increase of oxidation within the upper levels of the liquid. One solution of this problem has been to purge the area between the liquid surface and a sealed lid with an inert gas such as nitrogen. This process proves to be tedious and expensive, especially when the liquid volume fluctuates often.

Another solution has been to provide the holding tank with a lid that is vertically movable within the tank to follow the fluid level. Both floating and manually movable lids have been used with varying degrees of success.

The difficulties with manually movable lids is the tedium and possibility of oversight in moving the lid as liquid volume changes. Floating lids move automatically as the liquid volumes change and so eliminate the need for manual movement of the lid. The drawback here is that floating lids are often not effective as pressure seals and often allow interchange of gases from both sides of the lids. This is undesirable in instances, especially in wine making, where exposure of the liquid to the atmosphere is undesirable and where the fermentation process is kept in check by regulating pressure within the vessel.

U.S. Pat. No. 2,014,246 discloses a sealing device for storage tanks wherein a hollow core lid is shown floating on the surface of a liquid in a cylindrical tank. FIG. 3 of the drawings in this patent shows rigid top and bottom plates spaced by a peripheral inflatable seal. The plates are substantially horizontal and, as such, will not form a "pocket" of collected gases away from the peripheral rim. Furthermore, the rim itself is also used as the connecting wall between the vertically spaced plates. The flexible area therefore extends the full axial distance between the top and bottom plates. Special precautions must be taken to secure the seal to the plates.

U.S. Pat. No. 1,861,868 to D. E. Larson discloses a floating roof seal that makes use of a plurality of cylindrical buoyant sealing members that are urged against the upright side walls of the storage tank and against a conical surface of the lid to effect somewhat of a seal between the liquid and the atmosphere. Obviously, air spaces between the individual sealing members will allow at least some seepage of air or gases between the liquid and atmosphere.

A complex sealing arrangement using an inflatable rim is disclosed in U.S. Pat. No. 2,538,875 to Laird. Laird discloses a single flexible membrane spanning the surface of a liquid in a tank. This membrane is attached to an actuator valve that controls inflation of an annular seal. Inflation of the seal is dependent on deflection of the flexible cover.

U.S. Pat. No. 4,071,164 discloses a collapsible lid arrangement having an annular seal or serrated edge for engaging the inside walls of a spherical tank.

U.S. Pat. No. 1,650,340 is illustrative of a "floating" tank member that makes use of a series of overlapping inflatable tubes to produce a continuous seal around the lid periphery.

U.S. Pat. No. 2,664,220 is illustrative of a sliding seal for a "floating roof construction". Again, a single plate spans the liquid surface and an inflatable seal member as indicated in FIGS. 3 and 4 of the drawings are used to seal the liquid from the atmosphere.

U.S. Pat. No. 1,735,461 shows an inflatable seal for a single plate floating tank roof. This patent discloses use of a peripheral inflatable tube as a seal with the shape of the tube being alterable by a float situated within the liquid below.

U.S. Pat. No. 4,067,476 is illustrative of a mechanical sealing arrangement for liquid in a cylindrical tank. Here, instead of an inflatable tube, a toggle mechanism is used to press a sealing gasket against the tank side wall.

BRIEF DESCRIPTION OF THE DRAWINGS

A preferred form of the present invention is illustrated in the accompanying drawings in which.

DETAILED DESCRIPTION OF A PREFERRED EMBODIMENT

In compliance with the constitutional purpose of the Patent Laws "to promote the progress of science and useful arts" (Article 1, Section 8), applicant submits the following disclosure of the invention, illustrated by a preferred embodiment as shown in FIGS. 1 through 6.

Figure 1:
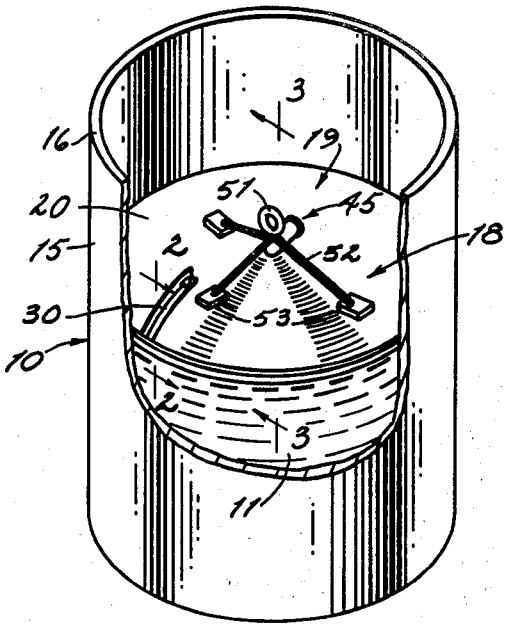
FIG. 1 is a pictorial view of a tank with a side wall thereof partially broken away to show the present structure.

The present invention is intended for use with a liquid storage tank such as the tank generally illustrated in FIG. 1 at 10. Tank 10 is used to store a liquid 11 and may be of a variety of conventional shapes. However, most liquid storage tanks of this nature are substantially cylindrical and include upright cylindrical walls 15 extending to a top edge 16. A conventional lid or cover (not shown) may be used in conjunction with the tank 10 without adversely affecting operation of the present floating lid structure which is generally indicated at 18.

The present lid structure 18 is provided to float on the liquid 11 and to selectively seal the liquid from exposure to the atmosphere above the tank. The present lid 10 spans the tank interior and is selectively sealed to the tank wall by elements described below. The lid will also float on the liquid surfce to maintain a level within the tank corresponding to the liquid level. This minimizes the undesirable formation of a large gas pocket or air space between the lid and the liquid surface. The seal prevents exchange of gases at the lid periphery and avoids exposure of the liquid to the atmosphere.

Details of the lid structure are shown in FIGS. 2 through 6. The basic components of the structural "body" of the lid include a top plate 19, an annular rim 26, and a bottom plate 35. These three elements together define an enclosed cavity 17 of sufficient size, in conjunction with the weight of the lid structure, to make the lid buoyant.

The top plate 19 of the lid includes an upwardly facing areal surface 20 that, preferably, is arched upwrdly, thereby adding rigidity to the plate. The surface 20 extends to a peripheral edge 21 that is shaped complementary to the interior configuration of the tank 10. Therefore, if the tank 10 is cylindrical, the peripheral edge 21 will be circular.

Figure 6:
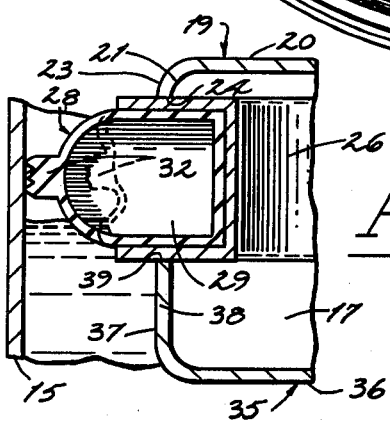
FIG. 6 is an enlarged fragmentary sectional view taken on line 6—6 in FIG. 4.
Figure 5:
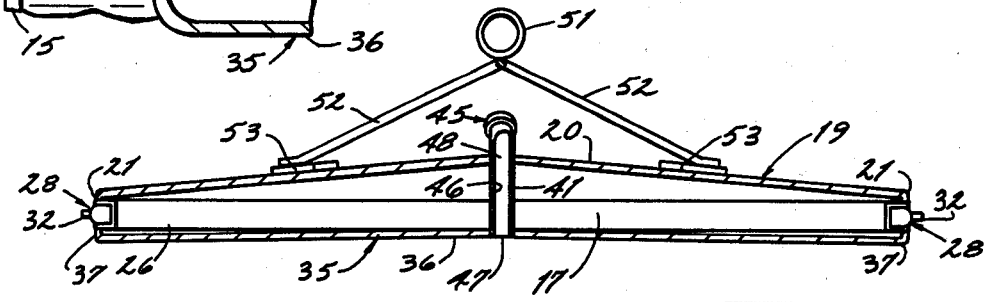
FIG. 5 is a cross-sectional view taken substantially on line 5—5 in FIG. 4.

The peripheral edge 21 is defined by an integral upright wall 23 formed in the plate 19. The wall 23 extends axially (with respect to the center axis of the tank and lid) downward to a horizontal edge surface 24 (FIG. 6). This surface 24 may be integral with or rigidly attached to the annular rim 26.

Figure 2:
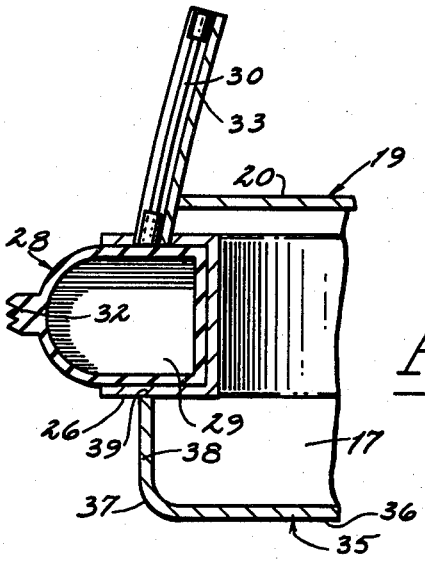
FIG. 2 is an enlarged sectional view taken substantially on line 2—2 in FIG. 1.
Figure 3:
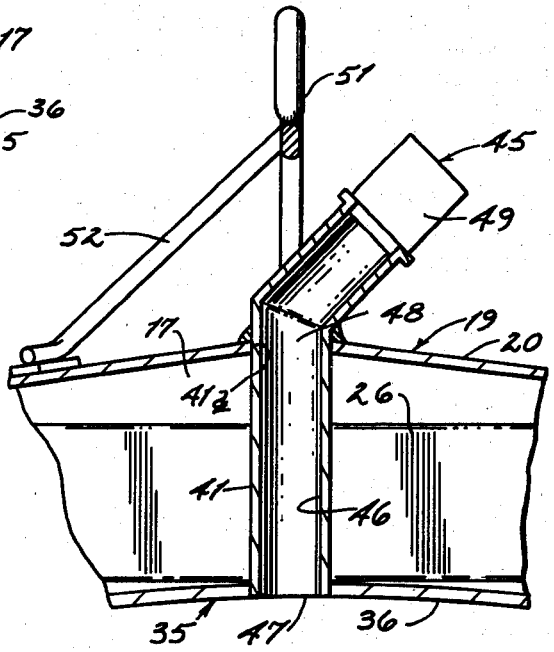
FIG. 3 is an enlarged sectional view taken substantially on line 3—3 of FIG. 1.
Figure 4:
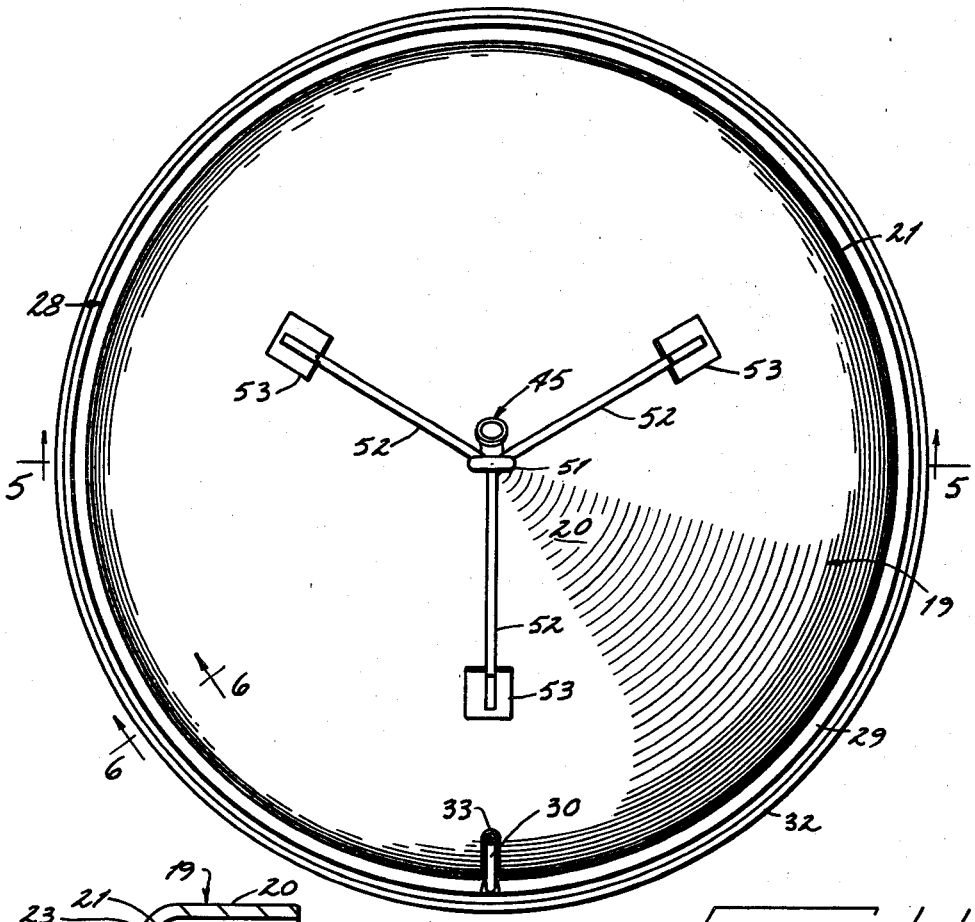
FIG. 4 is an enlarged top plan view of the present lid.

The rim is shown in section in FIGS. 2 and 6. It is substantially "C" shaped and is affixed by its top flange to the edge surface 24 of the top plate edge wall 23. The rim 26 extends continuously about the periphery of the top plate 19. In fact, the rim 26 may be integral with the plates 19, 35, and formed by portions of the plates.

A seal means 28 is provided on the rim and is adapted to engage the upright tank walls 15 for sealing the liquid within the tank from the atmosphere above. The seal means 28 may include an annular tube 29 extending continuously around the rim 26. The tube 29 may be inflatable by a valve stem 30 between the full and extended position shown by full lines in FIGS. 2 and 6 and a deflated condition as shown by dashed lines in FIG. 6 Filling of the tube can be simply accomplished by attaching a source of compressed air to the valve stem 30. Compressed air can be released from the tube simply by actuating the valve within the stem 30 to open and allow escape of air into the atmosphere. The valve stem is held in position by a guide 33 (FIG. 2) projecting upwardly from the top plate 19.

A serrated edge 32 (FIG. 2) extends around the tube 29. The serrated edge will engage and press against the upright side walls of the tank as the tube is inflated and will retract away from the walls when the tube is deflated.

The bottom plate 35 includes an areal surface 36 that faces downwardly, opposite the upwardly facing surface 20 of the top plate. The surface 36 extends to a peripheral edge 37 defined by an axial wall 38. The wall 38 extends upwardly to an edge surface 39 that is affixed to or integral with the rim 26. The wall 38 includes an axial dimension from the downwardly facing surface 36 to the serrated edge 32 that is greater than the distance from the serrated edge to the upwardly facing surface 20.

By this arrangement, the buoyancy of the lid is such that the serrated edge 32 will be carried slightly above the surface of the liquid at all times. This avoids possibility that liquid will be splashed onto the upwardly facing plate surface 20 upon inflation of the tube 29. It is very important to avoid contamination of liquids within the tank by other liquids that have been splashed onto the upper lid surface and exposed to the atmosphere over extended periods of time, then allowed to flow back into the tank.

The downwardly facing surface 36 of the bottom plate is arched upwardly by means of a tension member 41 extending between the two plates. The tension member 41 is situated at the centers of the plates 19 and 35. It extends substantially vertically between the plates and is affixed thereto and under tension to produce an upward arched or conical configuration in the bottom plate. The bottom plate will deflect in deference to the top plate due to the rigidity of the top plate afforded by its upwardly arched configuration.

Construction of the lid to produce the upward arch along the bottom plate 35 is accomplished by first welding or otherwise affixing the tension member 41 to the bottom plate. The tension member is then pulled upwardly through an appropriate aperture 41*a* (FIG. 3) in the top plate 19. The tension member is then fixed to the top member, leaving the member 41 in tension along its length and holding the bottom plate 35 in the upwardly arched configuration. The upward arch of bottom plate 35 serves to direct gas bubbles inwardly toward the center of the lid where they can be appropriately discharged through selective operation of a vent means generally shown at 45.

The vent means 45 may be comprised of a passageway 46 formed through the tension member 41. The passageway 46 includes an opening 47 through the bottom plate 35. The passageway also opens at 48 through the top plate 19. The passageway 46 is sealed by the tension member from the cavity.

A valve 49 (FIG. 3) may be positioned within the passageway 46 and is operable to allow escape of gas from a pocket formed under the bottom plate, after the gas has reached prescribed pressure. Such valves are typically used in the wine making industry and need not be described in further detail herein. It is sufficient to note that the valve is a "one way" acting valve and will allow only escape of gases outwardly from the area beneath the lid.

A lift ring 51 is positioned on the lid by means of radial struts 52. The ring is substantially centered on the lid and the struts radiate therefrom to pads 53 affixed to the top plate 19. The radiating struts are used to precisely center and balance the lid horizontally to facilitate lifting and lowering the lid into and out of a deep storage tank without binding.

Operation of the present invention may best be understood with reference to FIG. 1.

Once a liquid has been deposited into a tank 10, the lid may be lowered into place via the lift ring 51. The lid is lowered into position with the tube 29 deflated. This positions the serrated edge 32 adjacent to but not touching the tank side walls. The lid will float on the surface of the liquid, gradually supporting its own weight. Displacement of the liquid by the lid is such that the liquid will rise to the level indicated diagrammatically in FIG. 6 below the serrated edge 32. The tube 29 can then be inflated to move the serrated edge 32 into engagement with the tank walls. This effectively seals the liquid within the tank from the external environment.

Selection of inflation pressures will determine the extent of the seal and the ability of the lid to continue "floating" on the liquid surface. For example, if the tube 29 is inflated sufficiently, the lid will remain in position through a substantial pressure may build up under the bottom plate, as during certain fermentation processes. Gas bubbles will accumulate at the center of the bottom plate due to its upwardly arched configuration. The collected gas may be vented off through the passageway 46 and valve 49.

It is significant that the two plates 19 and 35 and the rim 26 form a sealed cavity and render the lid buoyant. If, for example, additional liquid is spilled into the tank over the surface of the top plate, the tube 29 can simply be deflated to allow the additional liquid to flow into the main body of liquid below and the lid will then float at the new liquid level within the tank.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

We claim:

1. A flotation lid for a cylindrical liquid storage tank having upright side walls, comprising:

a circular top plate having an integral peripheral wall extending axially to a downwardly facing edge surface;

a circular bottom plate having an integral peripheral wall extending axially toward the top plate to an upwardly facing edge surface;

an annular rim affixed to the edge surfaces of the circular top and bottom plates forming a sealed cavity defined with the top plate, the rim, and the bottom plate, of sufficient buoyance to float the lid on the liquid surface;

a circular serrated edge on the annular rim adapted to selectively engage the upright side walls of the tank to seal the tank interior below the bottom plate to minimize exposure of the liquid surface; and vent means extending between the top and bottom plates for selectively venting gases from below the bottom plate;

the top plate including an upwardly facing surface and the bottom plate including a downwardly facing surface and wherein the serrated edge is situated axially between the upward and downwardly facing surfaces; the bottom plate being arched upwardly and being held in its upwardly arched configuration by a tension member from the top plate.

2. The lid of claim 1 wherein the vent means includes a passageway formed through the tension member and opening into the area below the bottom plate; and a valve within the passageway selectively operable to open the passageway to the area above the top plate.

* * * * *